United States Patent [19]

Sager

[11] Patent Number: 4,902,203

[45] Date of Patent: Feb. 20, 1990

[54] HOUSING FOR DUAL OUTLET, DUAL ROTOR BLOWER

[76] Inventor: Harold W. Sager, 5925 Webster Rd., Orchard Park, N.Y. 14127

[21] Appl. No.: 266,518

[22] Filed: Nov. 3, 1988

[51] Int. Cl.[4] ..... F04B 39/06

[52] U.S. Cl. ..... 417/350; 417/369; 417/423.5; 417/423.8; 415/176; 415/177

[58] Field of Search ..... 417/366, 369, 423.5, 417/423.8, 423.14, 350; 415/176, 177, 180, 203, 206, 99, 103

[56] References Cited

U.S. PATENT DOCUMENTS

| | | | |
|---|---|---|---|
| 1,375,482 | 4/1921 | Bartlett . | |
| 2,066,652 | 1/1937 | Sherman . | |
| 2,703,199 | 3/1955 | Drake | 417/369 X |
| 2,710,573 | 6/1955 | Marker | 415/206 |
| 2,814,432 | 11/1957 | Eiserman | 417/369 X |
| 3,305,164 | 2/1967 | Laing | 417/369 X |
| 3,308,268 | 3/1967 | Laing . | |
| 3,348,020 | 10/1967 | Cooper . | |
| 3,390,830 | 7/1968 | Kahane . | |
| 3,780,411 | 12/1973 | Bulin | 415/206 X |
| 3,874,191 | 4/1975 | Hudson . | |
| 4,171,190 | 10/1979 | Hudson . | |
| 4,450,755 | 5/1984 | Catan | 415/206 X |

*Primary Examiner*—Leonard E. Smith
*Assistant Examiner*—Eugene L. Szczecina, Jr.
*Attorney, Agent, or Firm*—Stonebraker, Shepard & Stephens

[57] ABSTRACT

A housing (10) encloses a dual outlet, dual rotor blower between two cast parts (11 and 12) having internal partitions (31) dividing a volute region (30) of the housing. Flanges (32) on opposite ends of the motor (15) nest between the partitions for mounting the motor and its rotors (16) in the volute region. A discharge plenum (35) communicates with each of the rotors and spans the distance between them, and partitions (31) extend into the plenum. A pair of conveying nozzles (40) discharge from the plenum; but some of the air passes around the ends (33) of partitions (31), where it flows over motor (15) and out through vent openings (34). Confronting flanges (13, 14, and 24) are fastened together to assemble the motor and rotors within two cast parts (11 and 12).

10 Claims, 4 Drawing Sheets

HOUSING FOR DUAL OUTLET, DUAL ROTOR BLOWER

BACKGROUND

Dual rotor blowers can deliver air to dual outlets for a variety of purposes, but the housings for such blowers have been troublesome. I have been using a dual outlet, dual rotor blower to force air into a pair of pipes that vent storage compartments along port and starboard sides of a fire truck, and I have found the housings available for such a blower to be cumbersome and inefficient.

To simplify the installation and improve the air flow from a dual rotor blower into dual outlets, I have devised a housing that efficiently accomplishes everything necessary with two simple cast parts. My housing mounts the motor and rotors in place within a volute, efficiently directs the flow from the rotors to the dual outlets, provides for easy mounting of the blower, and delivers cooling air to the motor. My housing also accomplishes these functions with an economical casting that is good looking as well as functional.

SUMMARY OF THE INVENTION

My housing uses two cast parts for a dual outlet, dual rotor blower arranged in a volute region of the housing to deliver air from the blowers to two outlets. A pair of flanges extending radially outward around the ends of the motor nest between internal partitions dividing the volute region. The flanges engage the partitions to block air flow between the end regions containing the rotors and the central region containing the motor. A discharge plenum communicating with each of the rotors spans the distance between them, and the internal partitions extend into the plenum. A pair of converging nozzles discharge from the plenum; and confronting flanges, extending along the sides of the nozzles, fasten the two cast parts together. The central region of the volute has vent openings so that some of the air from the plenum is forced over the motor and out through the vent openings, to keep the motor cool. The converging nozzle outlets accelerate the flow and help make the housing efficient, and the discharge ends of the nozzles are preferably cylindrical for receiving sleeves that can couple to pipes. The bottom portion of the housing preferably has tapped holes to facilitate fastening the housing in place.

DRAWINGS

DETAILED DESCRIPTION

Figure 1:
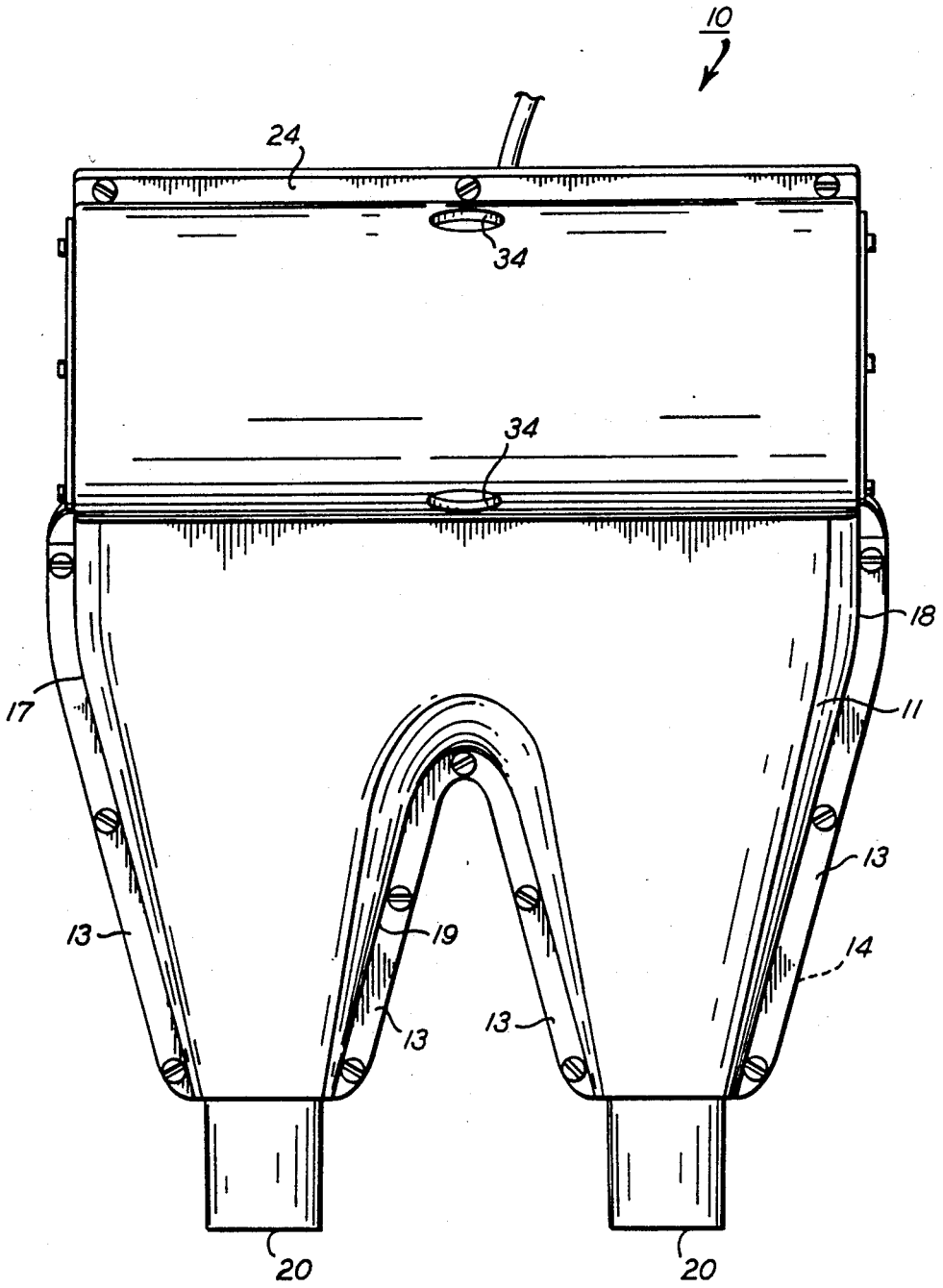
FIG. 1 is a plan view of a preferred embodiment of my blower housing.

I developed my blower housing to deliver air in two streams from a pair of rotors 16 turned by a motor 15 so that the air flows through a separated pair of outlets 20. For my purposes, outlets 20 are connected to plastic pipes 23 that extend through storage compartments on port and starboard sides of a fire truck. Although dual rotor blowers are available for powering dual outlets suitable for such a purpose, I have found the housings and outlet configurations available were difficult to mount and inefficient to operate. They constricted the outflow and consumed excessive time and materials for installation.

To solve these problems, I devised the blower housing 10 of this application. It provides separate dual outlets 20 and holds motor 15 and rotors 16 securely within a top 11 and a bottom 12 that are each formed as a simple casting. It automatically vents cooling air over motor 15, and it easily mounts the blower assembly on the truck and easily connects the dual outlets to pipes 23. Although developed for venting fire trucks, my housing may prove useful for other applications of dual rotor, dual outlet blowers.

Top 11 and bottom 12 have confronting flanges that are screwed or bolted together to assemble housing 10. Flanges 13 and 14 extend along side edges 17 and 18 and around a U-shape 19 between dual outlets 20. Flange 24 extends along top 11 at a rear region of housing 10.

Figure 2:
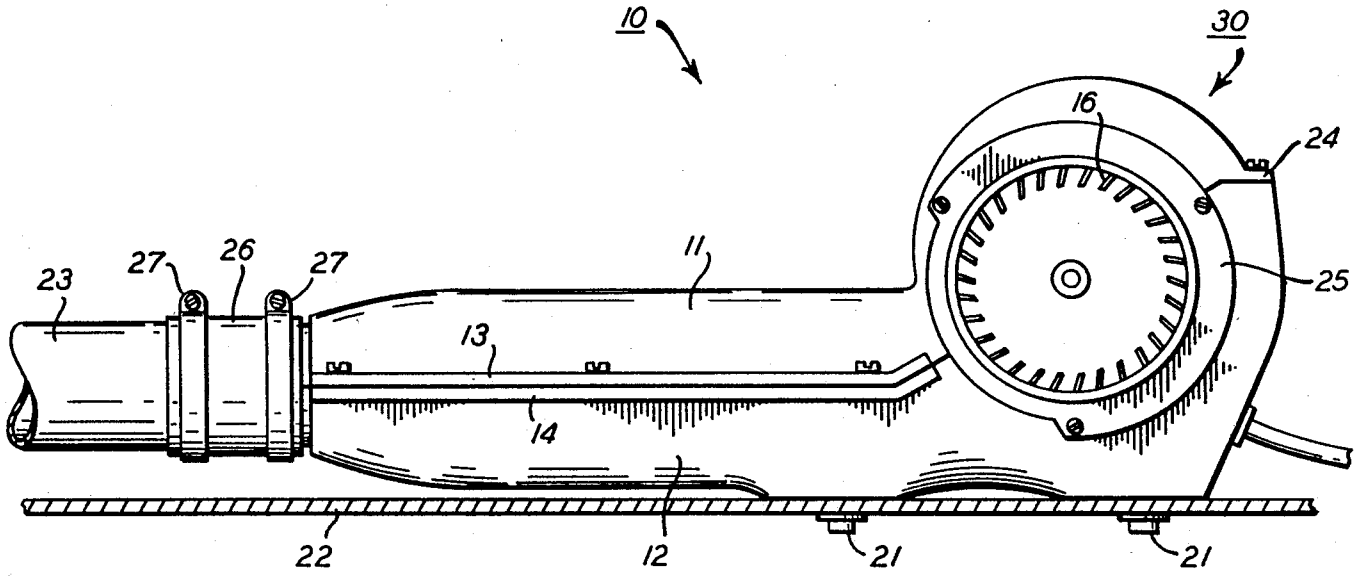
FIG. 2 is a side elevational view showing the blower housing of FIG. 1 fastened to a mounting panel.

Bottom casting 12 has tapped holes into which screws 21 can be threaded for mounting blower housing 10 on a panel 22, as shown in FIG. 2. This affords a simple and convenient mounting, compared with the mounting of previous housings.

Figure 3:
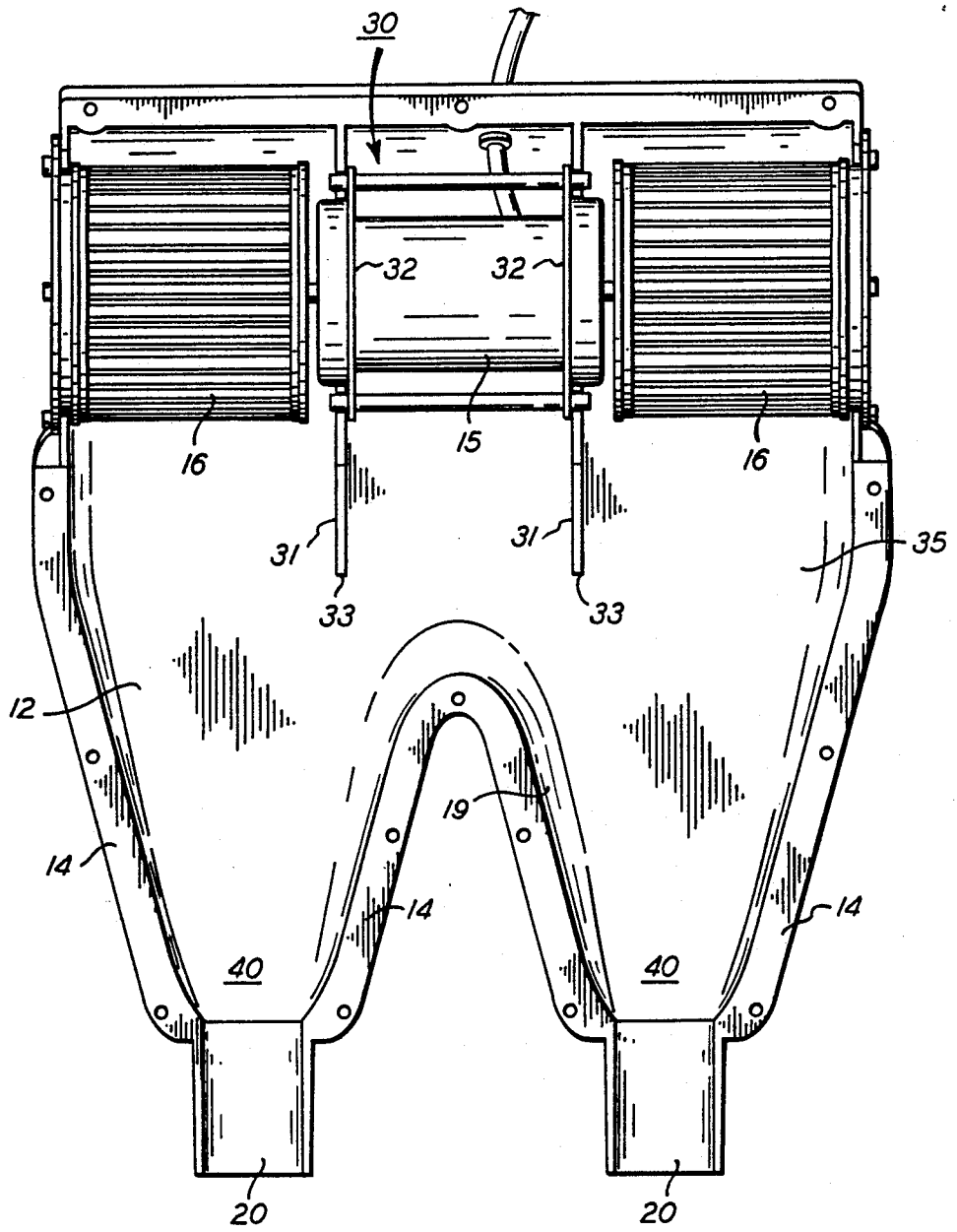
FIG. 3 is a plan view of the blower housing of FIG. 1, with the top part of the housing removed.

A volute region 30 encloses motor 15 and rotors 16, as best shown in FIG. 3; and within volute region 30 are internal partitions 31 that support motor 15. This is done by end flanges 32 that extend outward around the ends of motor 15 and nest within partitions 31. Flanges 32 are continuous or uninterrupted; and they fit snugly within partitions 31 so that they prevent any substantial air flow between motor 15, in a central region of volute 30, and rotors 16, in the opposite ends of volute 30. Air enters rotors 16 at opposite ends of volute 30, through circular openings trimmed with end rings 25.

Figure 4:
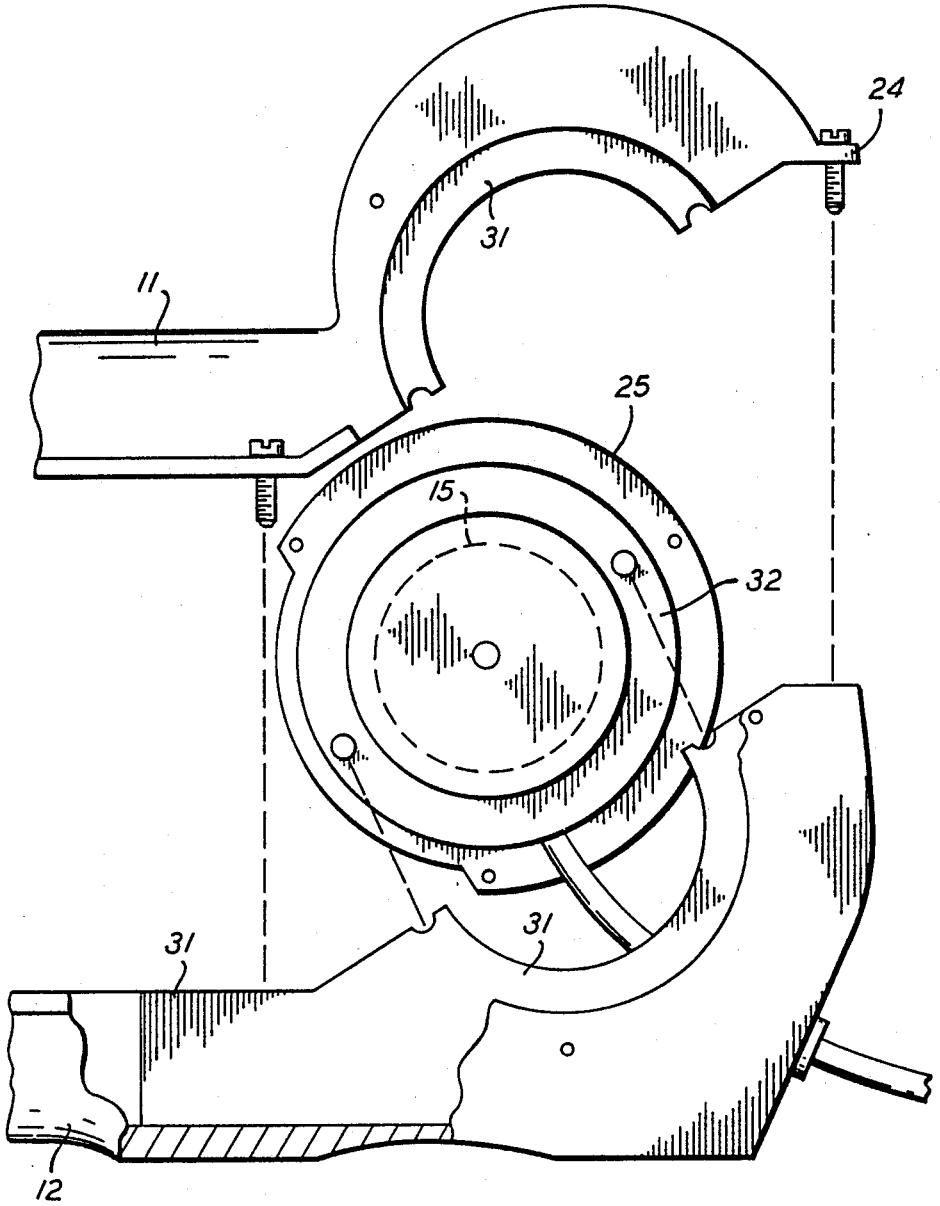
FIG. 4 is a partially cutaway, exploded view of the blower housing of FIG. 2, showing part of the blower.

Partitions 31 extend inward from both top 11 and bottom 12, as shown in FIG. 4, to overlap with each motor flange 32 around motor 15. Partitions 31 also meet each other and extend into a plenum region 35 positioned downstream of rotors 16. Plenum 35 spans the space between rotors 16, for the full width of housing 10; and the rounded end of the U-shape 19 between discharge regions 20 confronts plenum 35.

Partitions 31 stop short of U-shape 19, however, and allow some air to move through plenum 35, past the ends 33 of partitions 31. The central or motor region of volute 30 also has vent openings 34 allowing the escape of cooling air that flows over motor 15. Since the outflow from rotors 16 pushes air into plenum 35 and slightly pressurizes the air in plenum 35, this causes a portion of the outflow air from blower 16 to pass through plenum 35, around the ends 33 of partitions 31, over motor 15, and out through vent openings 34. This has proved to be an effective cooling system for keeping motor 15 from overheating. When applied to fire truck venting, it is desirable for motor 15 to run for several hours at a time so that an effective cooling system, using outflow air from rotors 16, is especially desirable.

From plenum 35, the outflow from rotors 16 enters a pair of tapered nozzles 40, leading to outlets 20. Nozzles 40 are thus on opposite sides of U-shape 19, and the legs of U-shape 19 extend along the inside edges of nozzles 40. The tapering or convergence of nozzles 40 accelerates the outflowing air through discharges 20 and helps optimize air flow from the blower through the dual outlets.

Discharge ends 20 are preferably unflanged and cylindrical so that a connecting sleeve 26 can be fitted over discharge ends 20 and over the ends of pipes 23 and held in place by clamps 27. This connects the dual outlets to pipes 23, which can have the same inside and outside diameters as discharge ends 20 so that air flow into the pipes is smooth and uninterrupted.

Tests with housing 10 show that it delivers substantially more outflow than previously available housings. It thus delivers more flow to pipes 23 and does a better job of venting the truck compartments. It also keeps motor 15 cool enough, by venting air out through openings 34, so that a thermal cutoff switch on motor 15 does not actuate.

Assemblying blower 10 is simply a matter of placing motor 15 and rotors 16 in bottom 12, covering them with top 11, and connecting flanges 13, 14, and 24. This automatically holds motor 15 and rotors 16 in place, with no other fastening being necessary. To mount blower 10, it is only necessary to thread mounting screws through panel 12 and into holes in bottom casting 12. This is quick and convenient, compared to the work involved with previous housings.

I claim

1. A two-part cast housing for a dual outlet, dual rotor blower, said housing having a volute region containing a motor and both rotors of said blower, said cast parts having internal partitions dividing said volute region between a central region containing said motor and end regions containing said rotors, and said housing comprising:

a. a pair of flanges extending radially outward around end regions of said motor, between said motor and said rotors, said flanges having an uninterrupted engagement with said partitions to block air flow between said end regions containing said rotors and said central region containing said motor;

b. a discharge plenum communicating with each of said rotors and extending throughout the distance between said rotors, said partitions extending into said plenum;

c. a discharge region of said plenum being divided by a U-shape into a pair of nozzles aligned respectively with said rotors, a rounded end of said U-shape being spaced from and oriented to confront said partitions, and legs of said U-shape forming sides of said nozzles, each of which converges toward a discharge end;

d. a vent opening in said central region so that air from said plenum can pass between said partitions around said motor and out through said vent opening; and e. confronting flanges of said cast parts being arranged around said U-shape between said nozzles and along outside edges of said nozzles opposite said legs of said U-shape, said cast parts being fastened together along said confronting flanges.

2. The housing of claim 1 wherein discharge ends of said nozzles are formed with round and unflanged exteriors suitable for receiving a coupling sleeve for coupling each of said nozzle ends to a pipe.

3. The housing of claim 1 wherein a base one of said cast parts has tapped holes for mounting said housing in place.

4. The housing of claim 1 including a plurality of said vent openings in said central region.

5. The housing of claim 1 wherein regions of said partitions extending into said plenum are directed toward and spaced from said side legs of said U-shape between said nozzles.

6. A housing formed of two cast parts fastened together for containing a motor and both rotors of a dual rotor blower having dual outlets, said housing having a volute with a central region housing said motor and end regions housing said rotors, and said cast parts having internal partitions extending between said motor and each of said rotors, said housing comprising:

a. outlets from said housing being formed as a pair of converging nozzles respectively aligned with said rotors for accelerating air outflow from said rotors;

b. entrance regions of said nozzles merging into a plenum spanning the distance between said rotors so that both rotors discharge into said plenum;

c. said partitions being positioned to divide said volute into said central and end regions, and said partitions extending into said plenum where said partitions terminate at a distance from said entrance regions to said nozzles so that an air communication pathway exists between said nozzles and said partitions within said plenum;

d. a vent opening in said central region of said volute so that air from said plenum can flow between said partitions and out through said vent opening, for cooling said motor; and e. confronting flanges of said two cast parts extending along said plenum and along opposite sides of said discharge nozzles, said cast parts being fastened together along said confronting flanges.

7. The housing of claim 6 wherein discharge ends of said nozzles are formed with round and unflanged exteriors suitable for receiving a coupling sleeve for coupling each of said nozzle ends to a pipe.

8. The housing of claim 6 wherein a base one of said cast parts has tapped holes for mounting said housing in place.

9. The housing of claim 6 including a plurality of said vent openings in said central region.

10. The housing of claim 6 wherein regions of said partitions extending into said plenum are directed toward and spaced from sides of said nozzles.

* * * * *